US010017891B1

(12) United States Patent
Oxford

(10) Patent No.: US 10,017,891 B1
(45) Date of Patent: Jul. 10, 2018

(54) NEEDLE ASSEMBLY FOR USE IN MANUFACTURING CARPETING

(71) Applicant: The Oxford Company, LLC, Cornwall, VT (US)

(72) Inventor: Amy S Oxford, Cornwall, VT (US)

( * ) Notice: Subject to any disclaimer, the term of this patent is extended or adjusted under 35 U.S.C. 154(b) by 0 days.

(21) Appl. No.: 15/885,338

(22) Filed: Jan. 31, 2018

(51) Int. Cl.
*D04G 3/02* (2006.01)
*D05C 15/06* (2006.01)

(52) U.S. Cl.
CPC ..... *D05C 15/06* (2013.01); *D04G 3/02* (2013.01)

(58) Field of Classification Search
CPC ..... D05C 15/145; D05C 15/22; D05B 85/00; D04D 11/00; D04G 3/02
See application file for complete search history.

(56) References Cited

U.S. PATENT DOCUMENTS 3,189,237 A * 6/1965 Wilfert ..... D05C 15/06 112/80.05
3,867,888 A * 2/1975 Morissette ..... D05C 15/06 112/80.03
3,968,757 A * 7/1976 Doyel ..... D05C 15/06 112/80.03
3,977,336 A * 8/1976 Gauslow ..... D05C 15/06 112/80.04
4,006,694 A 2/1977 Thaheld et al.
4,124,153 A * 11/1978 Mann ..... D04G 3/02 223/102
4,475,473 A 10/1984 Samoilov et al.
5,555,826 A 9/1996 Satterfield
8,117,976 B2 2/2012 Tamura
8,991,020 B2 3/2015 Sasur
2008/0171983 A1 7/2008 Knutson

FOREIGN PATENT DOCUMENTS

CN 2723478 9/2005
CN 201880015 6/2011

* cited by examiner

*Primary Examiner* — Tejash Patel
(74) *Attorney, Agent, or Firm* — Keegan Caldwell; Micah T. Drayton

(57) ABSTRACT

A needle assembly for use in carpeting includes a handle having a first longitudinal axis running from a forward end to a rear end, a shaft section running along the first longitudinal axis with a first portion having a first outer diameter and a second portion, where the second portion has a second outer diameter representing a maximal outer diameter of the second portion, and the second outer diameter is less than the first outer diameter, a first bore a first maximal diameter and a front-end opening. The needle assembly includes a needle having a shank with a second maximal diameter permitting insertion of the shank in the first bore. The needle includes a blade disposed between the shank and the front end, and a tip section disposed between the blade and the front end, having a transverse opening, and terminating with a pointed tip.

16 Claims, 7 Drawing Sheets

NEEDLE ASSEMBLY FOR USE IN MANUFACTURING CARPETING

FIELD OF THE INVENTION

The present invention generally relates to the field of tools for textile manufacture. In particular, the present invention is directed to a needle assembly for use in carpeting.

BACKGROUND

Rug hooking is a popular process for producing rugs, in which loops of yarn are repeatedly pushed or pulled from a reverse side of a textile material to an obverse side, forming a "pile" of multiple loops of yarn on the obverse side; yarns with contrasting colors may be used to create patterns in the pile. This has traditionally been performed using a tool known as a rug hook which has a similar overall design to a crochet hook to pull loops, or using a punch needle to push them, requiring in either case repeated insertion and retraction of the tool used. Making loops of a consistent size rapidly enough to be practical using such tools has traditionally been challenging, requiring a high level of skill. The repeated act of insertion and extraction of the tool can also be wearing on a user's grip, making the challenges mount as the project progresses, particularly for users having arthritis or other issues affecting their manual strength, endurance, and dexterity. The repeated act of insertion and extraction of the tool can be wearing on a user's fingers, hands, wrists, and arms. This can represent a significant impediment to anyone interested in learning the new craft, or anyone who uses the tool for a long period of time.

SUMMARY OF THE DISCLOSURE

In one aspect, a needle assembly for use in carpeting includes a handle having a forward end and a rear end and a first longitudinal axis running from the forward end to the rear end. The handle includes a shaft section running along the first longitudinal axis; the shaft section has a first portion, the first portion having a first outer diameter representing a maximal outer diameter of a first portion and a second portion, the second portion having a second outer diameter representing a maximal outer diameter of the second portion, and the second outer diameter is less than the first outer diameter. The handle includes a first bore running along the first longitudinal axis, the first bore having a first maximal diameter, the first bore having a front-end opening in the front end of the handle. The needle assembly includes a needle, that has a front end and a back end and a second longitudinal axis running from the front end to the back end. The needle includes a shank having a terminal end at the back end, the shank having a second maximal diameter permitting insertion in the first bore. The needle includes a blade, the blade disposed between the shank and the front end. The needle includes a tip section, the tip section disposed between the blade and the front end, the tip section having a transverse opening through the tip section, the tip section terminating at the front end with a pointed tip.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention.

However, it should be understood that the present invention is not limited to the precise arrangements and instrumentalities shown in the drawings, wherein.

DETAILED DESCRIPTION

In an embodiment, this disclosure is directed to a hand-held needle assembly for use in rug-hooking and similar endeavors. Hand-held needle assembly may include a needle having a shank securely inserted into a bore in a handle, creating a compression fit to maintain the needle in place during use. Needle assembly may have a channel in its projecting portion that communicates with the bore, or with a bore in the shank, allowing a yarn to be threaded through the bore and the needle channel to a transverse hole in the needle tip. A slit in the handle may permit easy insertion of the yarn. In operation, yarn may be continuously threaded through the bore, channel, and hole, permitting rapid insertion and looping. The handle may have one or more flanges and surface variations for ease of gripping during operation. In an embodiment, needle assembly may function as a "punch needle." The punch needle may be threaded with a flexible material such as yarn, string, strips of cut fabric, or other fibers and is pushed down through a textile material; insertion and withdrawal of a punch needle may form a loop of the flexible material. When the tool is used correctly all the loops may have a uniform height, creating an even rug pile.

Figure 1:
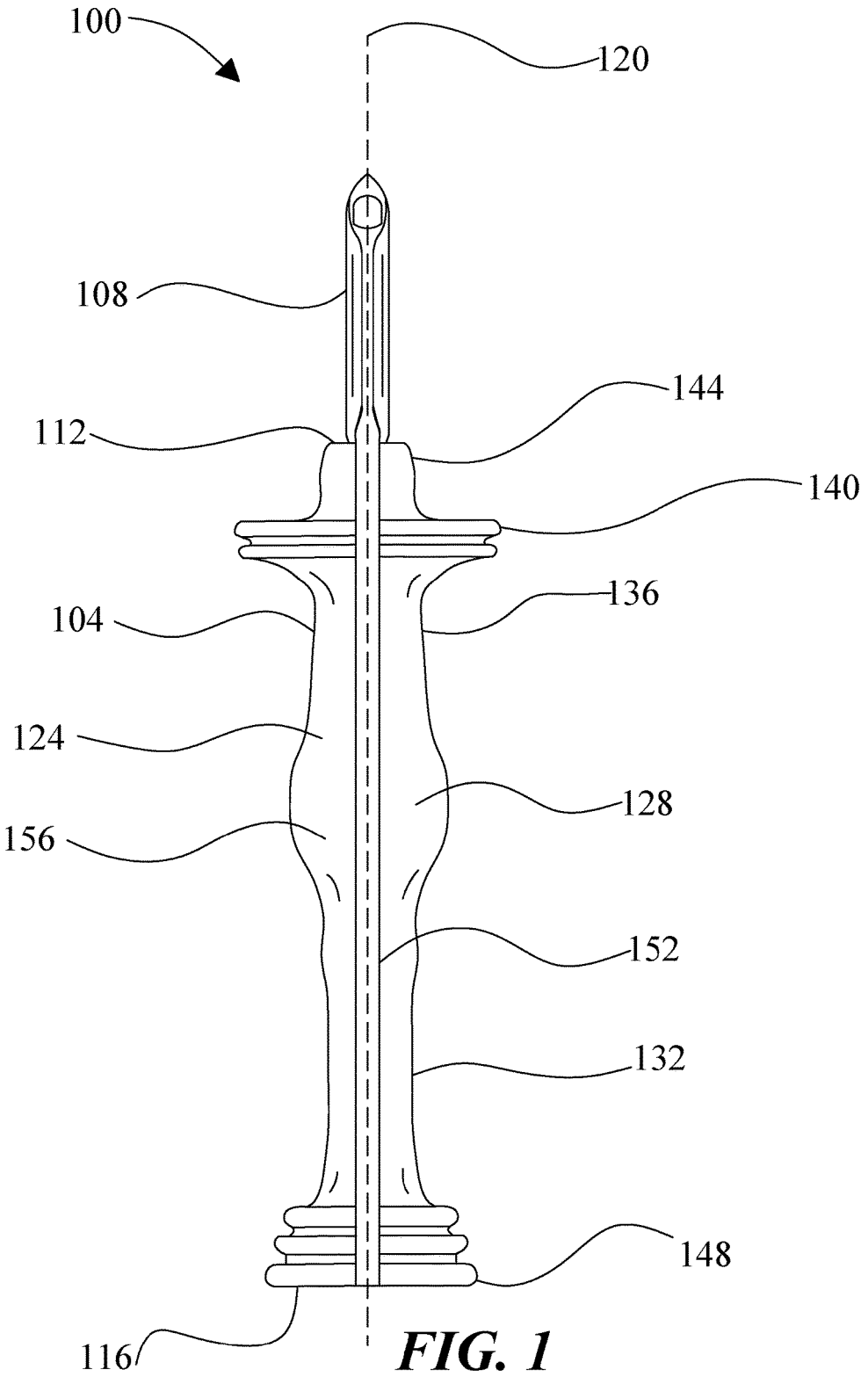
FIG. 1 is schematic diagram illustrating a non-limiting example a side-view of a needle assembly in an embodiment.

Turning now to FIG. 1, an exemplary embodiment of a needle assembly 100 for use in carpeting. Needle assembly 100 includes a handle 104 and a needle 108. Handle 104 may be composed of any suitable material or combination of materials, including without limitation artificial or natural polymer materials such as rubber, resin, or plastics, metal, ceramic, composite materials such as fiberglass, glass, wood, leather, textiles, foams, and/or stuffing materials such as cotton wool or other textile stuffing. Handle 104, and features of handle that will be introduced in this disclosure may be manufactured using any suitable manufacturing method or combination manufacturing methods, including without limitation molding, additive manufacturing such as without limitation "3-D printing," and/or subtractive manufacturing such as without limitation computer numerical control (CNC) machining, boring, broaching, turning on a lathe, cutting with saws, and the like.

With continued reference to FIG. 1, handle 104 has a forward end 112 and a rear end 116. Handle 104 includes a first longitudinal axis 120 running from the forward end to the rear end. First longitudinal axis 120 may be an axis of symmetry; for instance, and without limitation, handle 104 may be rotationally symmetrical about first longitudinal axis 120. Rotational symmetry, as used herein, is rotational symmetry excluding a slit in handle, where present, as described in further detail below. Handle includes a shaft section 124. Shaft section 124 runs along first longitudinal axis 120; that is, shaft section 124 may be rotationally symmetrical about first longitudinal axis 120. Shaft section 124 may be substantially elongate. Shaft section 124 includes a first portion 128. First portion 128 has a first outer diameter 132 representing a maximal outer diameter of first portion 128. As used herein, a "diameter" is a length of a line segment drawn from a first point on an exterior surface of handle 104 to a second point of exterior surface of handle 104 and crossing first longitudinal axis 120 at a right angle; where handle 104 is rotationally symmetrical about first longitudinal axis 120, a transverse cross-section of handle 104 encompassing both first point and second point may be substantially circular. In an embodiment, first portion 128 has a first transverse cross-sectional area representing the maximal transverse cross-sectional area of first portion 128; transverse cross-sectional area is defined herein as the area of a planar section taken through handle 104 orthogonally to first longitudinal axis 120. "Transverse," as used herein, generally means "in a direction orthogonal to the applicable longitudinal axis."

Still referring to FIG. 1, shaft section 124 may additionally include a second portion 132. Second portion may be directly or indirectly connected to first portion 128. Second portion 132 may have a second outer diameter representing a maximal outer diameter of the second portion 132, as defined above in reference to first portion 132. Second outer diameter may be less than first outer diameter; in other words, when moving from second portion 132 to first portion 128, handle 104 may bulge outward, while in moving from first portion 128 to the second portion 132 handle 104 may taper inward. Second portion 132 may be disposed between first portion 128 and rear end 116; alternatively, second portion 132 may be disposed between first portion 128 and forward end 112.

Continuing to refer to FIG. 1, shaft section 124 may include a third portion 136. Third portion 136 may be directly or indirectly connected to first portion 128 and/or second portion 132. Third portion 136 may have a third outer diameter; third outer diameter may represent a maximal outer diameter of the third portion 136 as defined above for first diameter of first portion 128. Third diameter may be less than first diameter. Third diameter may be more than first diameter. Third diameter may be more than second diameter. Third diameter may be less than second diameter. Third portion 136 may be disposed between first portion 132 and rear end 116. Third portion 136 may be disposed between second portion 132 and forward end 112. Third portion 136 may be disposed between second portion 132 and forward end 112. Third portion may be disposed between second portion and rear end 116. Third portion may be disposed between second portion 132 and first portion 128. Persons skilled in the art will be aware, upon reading the entirety of this disclosure, of various ways in which first portion 128, second portion 132, and third portion 136 may be arranged relative to each other. First portion 128, second portion 132, and/or third portion 136 may grade smoothly into one another; in other words, a surface of shaft section 124 may curve continuously from one thickness to another as it passes over the sections. In an embodiment, first portion forms a thicker portion or "bump" on shaft section 124, making the shaft section 124 easier to grip while pushing and pulling needle assembly 100 through textile material as described in further detail below.

Still referring to FIG. 1, handle 104 may include a front-end flange 140. Front-end flange 140 may be located at front end 112. Front-end flange 140 may separate shaft section 124 from front end 112. Front-end flange 140 may have a fourth outer diameter; fourth outer diameter may represent a maximal outer diameter of front-end flange 140, for instance as defined above in reference to first diameter of first portion 128 of shaft section 124. In an embodiment, fourth outer diameter may be greater than first outer diameter; in other words, an outer surface of handle 104 may bulge outward when traversed from shaft section 124 forward to front-end flange 140. In an embodiment, front-end flange 140 provides a surface area against which a hand of a user may push when inserting needle 108 through textile as described in further detail below.

With continued reference to FIG. 1, handle 104 may include a collar 144 located at the front end 112. Collar 144 may have a fifth outer diameter; fifth outer diameter may represent a maximal outer diameter of the collar 144, for instance as defined above in reference to first outer diameter of first portion 128. Fifth diameter outer diameter may be less than fourth outer diameter. Fifth outer diameter may be greater or less than first, second, and/or third diameter. Fifth diameter 144 may be less than third and fourth diameter. Collar 144 may surround front-end opening of a bore as described in further detail below, and may lend stability to needle 108 during operation of assembly 100.

Still referring to FIG. 1, handle 104 may include a rear-end flange 148. Rear-end flange 148 may be located at rear end 116. Rear-end flange 148 may separate shaft section 124 from rear end 116. Rear-end flange 148 may have a sixth outer diameter; sixth outer diameter may represent a maximal outer diameter of rear-end flange 148, for instance as defined above in reference to first diameter of first portion 128 of shaft section 124. In an embodiment, sixth outer diameter may be greater than first outer diameter; in other words, an outer surface of handle 104 may bulge outward when traversed from shaft section 124 forward to rear-end flange 148. Sixth diameter 148 may be larger than second diameter 132. In an embodiment, rear-end flange 148 provides a surface area against which a hand of a user may push when pulling needle 108 out of textile as described in further detail below.

Figure 2:
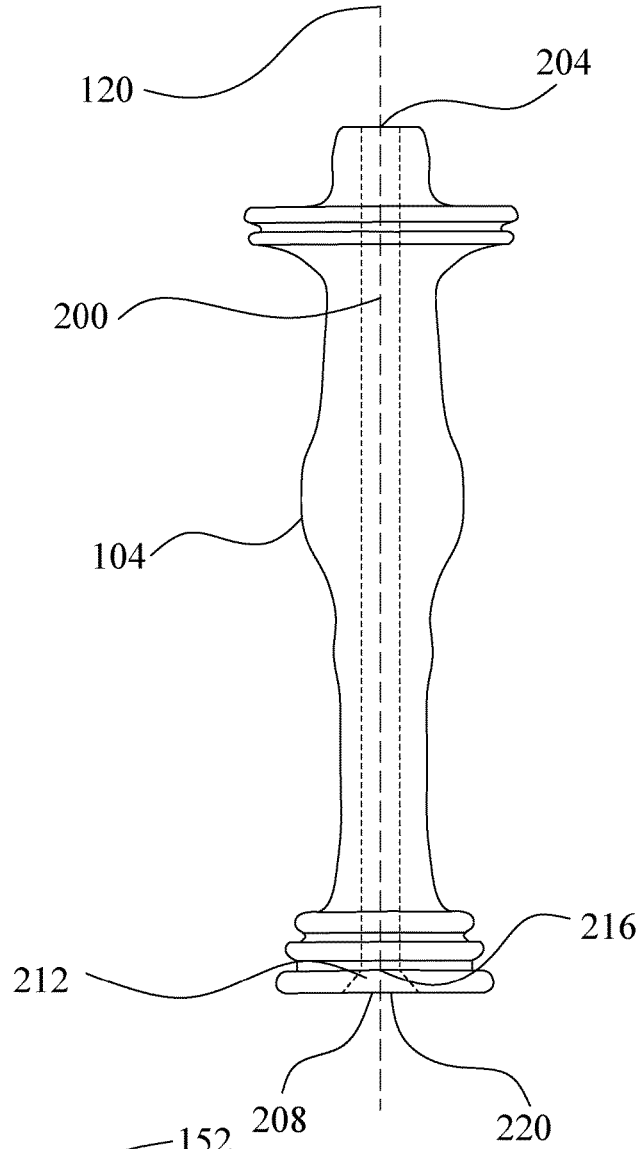
FIG. 2 is schematic diagram illustrating a non-limiting example a side-view of a handle in an embodiment.

Referring now to FIG. 2, handle 104 includes a first bore 200 running along the first longitudinal axis 120. First bore 200 may be substantially cylindrical. First bore 200 may be formed by any suitable manufacturing process, including without limitation drilling or machining the first bore 200 out of handle 104. Collar 144, where present, may be disposed about first bore 200 as described above. First bore 200 has a first maximal diameter, where diameter as used for the definition of first maximal diameter means a length of a line segment connecting a first point on an interior surface of first bore 200 to a second point on the interior surface and intersecting first longitudinal axis 120 at a right angle. First maximal diameter is defined with respect to the diameter of bore 200 excluding a slit or bevel as described below; in other words, it is the maximal diameter measured as if the slit and/or bevel were not present, in a main portion of first bore 200. First bore 200 has a front-end opening 204 in the front end 112 of the handle; front-end opening 204 may be an opening in, or surrounded by, collar 144.

Still referring to FIG. 2, first bore 200 may also include a rear-end opening at rear end 116 of handle 104; in other words, first bore 200 may be a through-hole through handle 104, running from front-end opening 204 to rear-end opening 208. Rear-end opening 208 may include a bevel section 212 separating first bore 200 from rear end 116. Bevel section 212 may include a first end 216 at rear end 116; first end 216 may have a first cross-sectional area. Bevel section 212 may include a second end 220 connected to first bore, where "connected," as used herein in referring to spaces or cavities within a body, indicates that the spaces or cavities share internal space, and that an object within one internal space may pass into another where the two are connected. Second end 220 may have a second cross-sectional area. Second cross-sectional area may be less than first cross-sectional area; in other words, bevel section 212 may have a form similar to a funnel with its large opening at rear end 116 and small opening at first bore 200.

Figure 3:
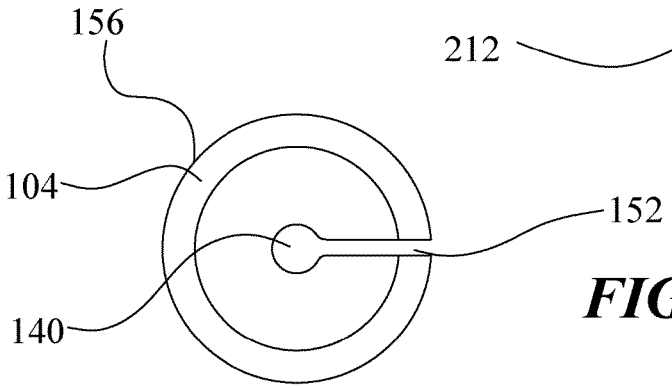
FIG. 3 is a schematic diagram illustrating a non-limiting example of an end-view of a handle in an embodiment.

Referring again to FIG. 1, handle 104 may include a first slit 152. First slit 152 may run along first longitudinal axis 120. First slit 152 may extend the full length of first bore 200; for instance, where first bore 200 includes a rear-end opening 208, first slit 152 may extend the full length of handle 104. First slit 152 may connect first bore 200 to an exterior surface 156 of handle 104. Referring now to FIG. 3, a non-limiting example of a transverse cross-sectional view of handle 104 is shown, with first slit 152 connecting interior space of first bore 200 to exterior surface 156 of handle 104; as a result, an elongate object such as a yarn, string, or the like may be inserted into first bore 200 via first slit 152, with the result that the elongate object extends through bore 200 along first longitudinal axis 120, as described in further detail below.

Referring again to FIG. 1, handle 104 may further include a finish. Finish may be an exterior coating or treatment. Finish may protect an exterior or interior surface of handle from wear, moisture, or the like. Finish may make needle assembly 100 easier to manipulate; for instance, the finish may make the surface of handle 104 smoother, reducing friction against a user's skin. Finish may be formed in any suitable manner from any suitable material, including without limitation polyurethane coating.

Continuing to refer to FIG. 1, needle 108 may be constructed of any suitable material, including without limitation metal; metal may include steel. In an embodiment, needle 108 may be constructed of stainless steel. Needle 108 may be manufactured using any suitable manufacturing method or combination of methods, including without limitation molding, sheet metal processes such as stamping, cutting, or bending, additive manufacture, and/or subtractive manufacture such as CNC machining, boring, broaching, and the like. Additional information concerning potential techniques for manufacture of needle 108 is described below where applicable.

Figure 4A:
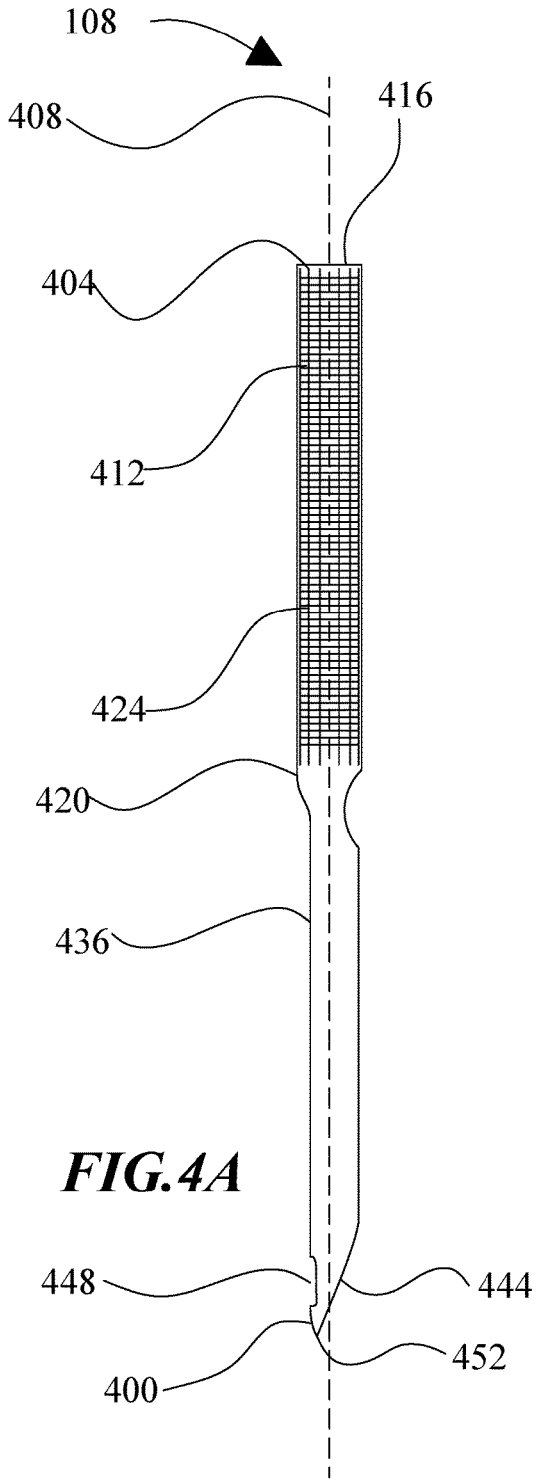
FIGS. 4A-C are lateral views of non-limiting examples of needles in embodiments.
Figure 4B:
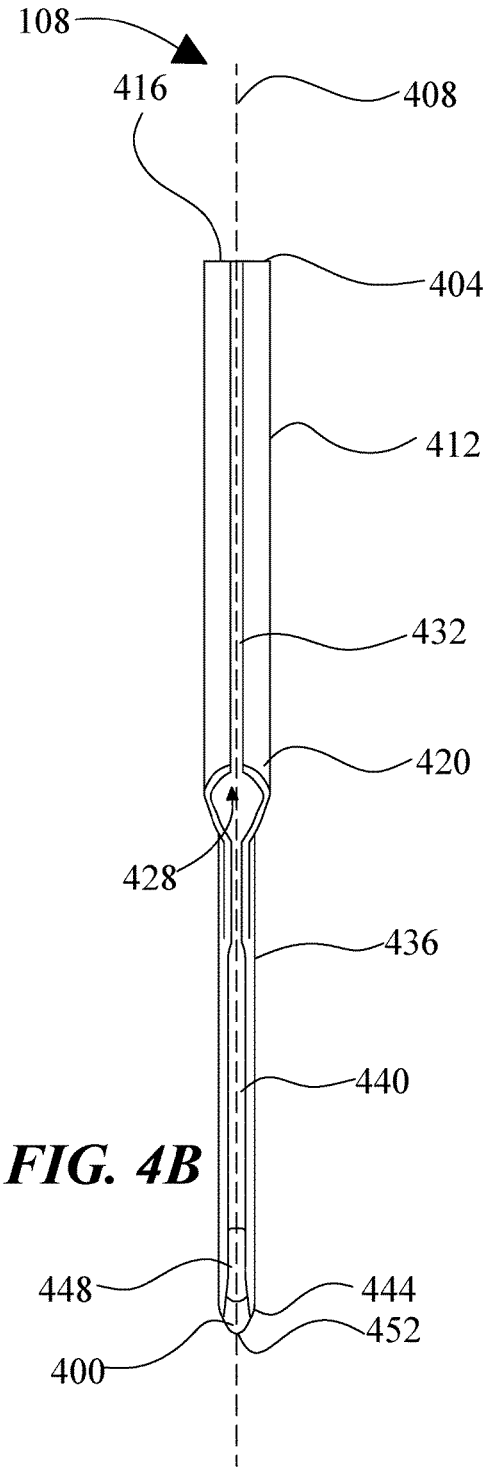
Figure 4C:
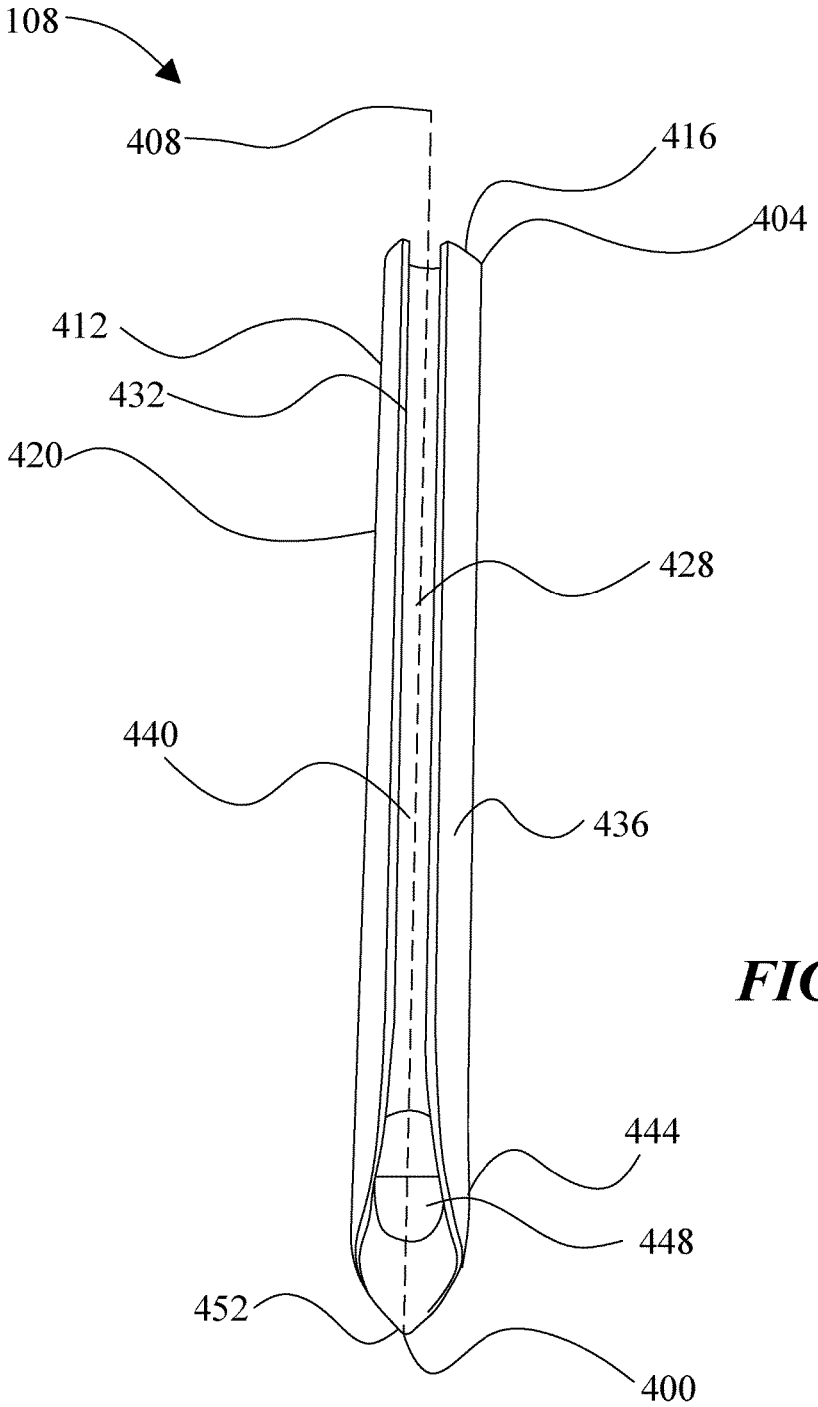

Still referring to FIG. 1, needle 108 may be joined to handle 104. Referring now to FIGS. 4A-C, exemplary embodiments of needle 108 are illustrated. Needle 108 includes a front end 400 and a back end 404. Needle 108 includes a second longitudinal axis 408 running from front end 400 to back end 404. Second longitudinal axis 408 may be substantially identical to first longitudinal axis 120 when needle 108 is joined to handle 104. Needle 108 includes a shank 412, defined herein as a portion of the needle 108 inserted into bore 200. Shank has a terminal end 416 at back end 404. Shank has an interior end 420 connecting to remainder of needle 108 as described in further detail below. Shank 412 may have a length equal to any fraction of a length of first bore 200; the shank 412 may be as long as the bore 200, be longer than the bore 200, or have a length equal to any fractional portion of the length of the bore 200.

With continued reference to FIGS. 4A-C, shank 412 has a first maximal diameter. Second maximal diameter may permit insertion of shank 412 into first bore 200; insertion may include full or partial insertion. A diameter as used in this instance is defined as the length of a line segment drawn from a first point on an exterior surface of shank 412 to a second point on the exterior surface, the line segment intersecting second longitudinal axis 408 at a right angle. Shank 412 may be secured in first bore 200 using an adhesive. Adhesive may be any adhesive, including without limitation cyanoacrylate glues, epoxy resin/hardener combinations, pressure adhesives, and the like. Shank 412 may alternatively or additionally be secured by other means; for instance, in an embodiment, second maximal diameter may be a maximal diameter of shank 412 when in an elastically neutral state; that is, when shank 412 is not being subjected to any net compressive force, shank 412 may be measured as having a second maximal diameter. Second maximal diameter may be greater than the first maximal diameter. As a result, insertion of shank 420 into first bore 200 may compress shank, generating an elastic recoil force against an internal surface of the first bore 200; the elastic recoil force may hold shank 412 in place within first bore 200, preventing shank 412 from slipping while needle assembly 100 is in use.

As shown in FIG. 4A, shank 412 may have a textured outer surface 424. A textured outer surface, as used herein, is an outer surface that has a higher coefficient of static friction than the outer surface would possess if it remained smooth, or presented a typical, untreated surface resulting from the manufacture of shank 412. A texture outer surface may provide greater surface area for attachment of adhesive material such as epoxy. Textured outer surface 424 may be created by scoring outer surface using lasers, machine tools, sanders, or any other item suitable for selective removal of material by scratching or forming channels or cavities in the surface. Textured outer surface 424 may alternatively or additionally be formed by the deposition of material. In an embodiment, textured outer surface 424 may combine with elastic recoil force as described above to aid in securing shank 412 within first bore 200. Needle assembly 100 may be assembled by insertion of shank 412 into first bore; insertion may be performed with significantly greater force than forces to which needle assembly 100 is subjected during operation.

Figure 4D:
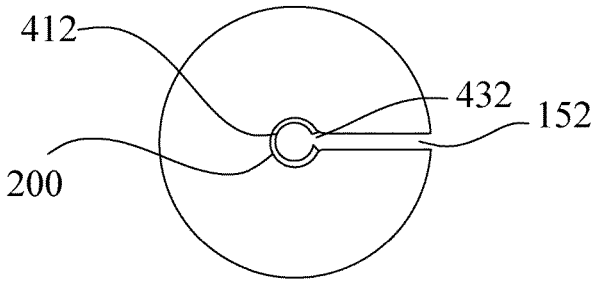
FIG. 4D is a transverse cross-section of a non-limiting example of a handle with inserted shank in an embodiment.

Referring now to FIG. 4B, shank 412 may include a second bore 428 running through the shank 412 in the direction of the second longitudinal axis 408. Second bore 428 may have any form suitable for first bore 200. Second bore 428 may be formed by any suitable manufacturing method or methods as described above in reference to FIGS. 1-3. Second bore 428 may run the full length of shank 412; in other words, second bore 428 may have a first opening at terminal end and a second opening at interior end. Shank 412 may include a second slit 432. Second slit 432 may connect second bore 428 to exterior surface 424 in the same way that first slit 152 of handle 104 may connect first bore 200 to exterior surface 156 of handle 104 as described above. Second slit 432 may permit an elongated object such as a length of yarn to be inserted into second bore 428 via second slit 432. In an embodiment, and as shown as a non-limiting example in FIG. 4D, shank 412 may be inserted into first bore 200 with second slit 432 lined up with first slit 152; the result may be that an elongate object such as a length of yarn may be inserted through first slit 152 and second slit 432 into interior of second bore 428 and so much of first bore 200 as is not occupied by shank 412.

Referring again to FIGS. 4A-C, needle 108 includes a blade 436. Blade 436 is disposed between shank 412 and front end 400; in other words, blade 436 connects to internal end of shank 412. Blade 436 and shank 412 may be formed from a single piece of metal; alternatively, blade 436 may be fused to shank 412 by welding, brazing, riveting, or the like. There may or may not be a visible delineation between blade 436 and shank 412. Blade 436 and/or shank 412 may be formed using a substantially flattened length of metal, such as a sheet of metal having a uniform thickness. The substantially flattened piece of metal may then be bent to form a transverse curvature; it should be noted that blade 436 may be formed in any other way producing a result similar to a flattened piece of metal so bent. The curvature may be formed by other means, including without limitation additive or subtractive processes, molding, or the like. The curvature may form a channel in blade 436; channel 440 may run parallel to second longitudinal axis 408. Channel 440 may connect to second bore 428, where present; in other words, an elongate object such as a length of yarn may be laid in a substantially straight line within channel and inserted through the second bore 428. Where shank 412 includes a second slit 432 as described above, second slit 432 may open into channel 440, so that an elongate object may be laid within second bore 428 and channel 436 via slit and the opening of channel 436.

Figure 5A:
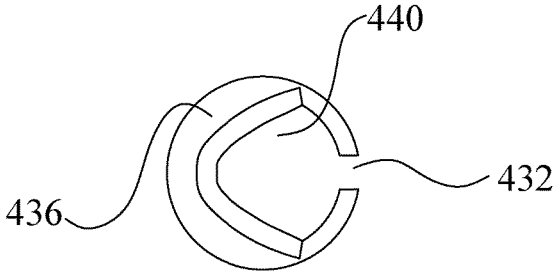
FIGS. 5A-C are transverse cross-sections of a non-limiting example of a blade in an embodiment.
Figure 5B:
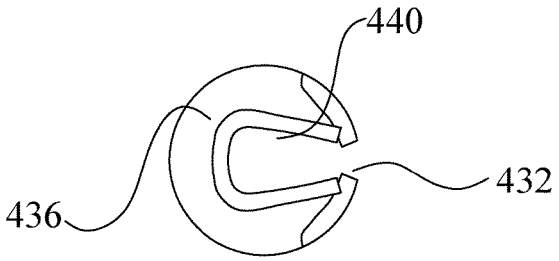
Figure 5C:
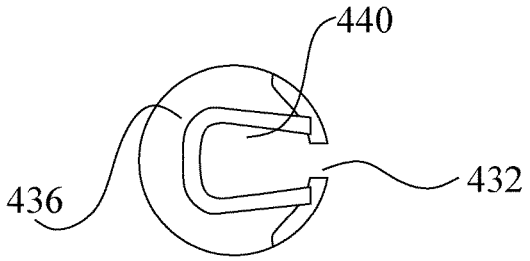

FIGS. 5A-C illustrate non-limiting examples of modifications to which curvature of channel 440 may be subjected through the length of blade 436. As a non-limiting example, and as illustrated for instance in FIG. 5A, channel 440 may initially have a relatively shallow curvature, representing, for instance, a substantially parabolic form; this may correspond to a relatively flattened section of blade 436 adjacent to internal end of shank 412. As a further non-limiting example, and as illustrated for instance in FIG. 5B, channel 440 may have a deeper curvature, such as a substantially U-shaped curvature, in a subsequent section of blade 436 disposed between the section represented in FIG. 5A and front end 400; this section may also be less flattened than the section shown in FIG. 5A. As a further non-limiting example, channel 440 may have a slightly modified U-shaped curvature in a third section disposed between the section in FIG. 5B and front end 400. As illustrated for instance in FIGS. 5B-C, channel 440 may, at some points along the length of blade 436, have sides that overhang the interior of channel 440 to some extent; this may have the effect of securing an elongate member that has been inserted into the channel 440 within the channel 440. Channel may be viewed, in a non-limited example, as being on a ventral side of blade 436.

Figure 6:
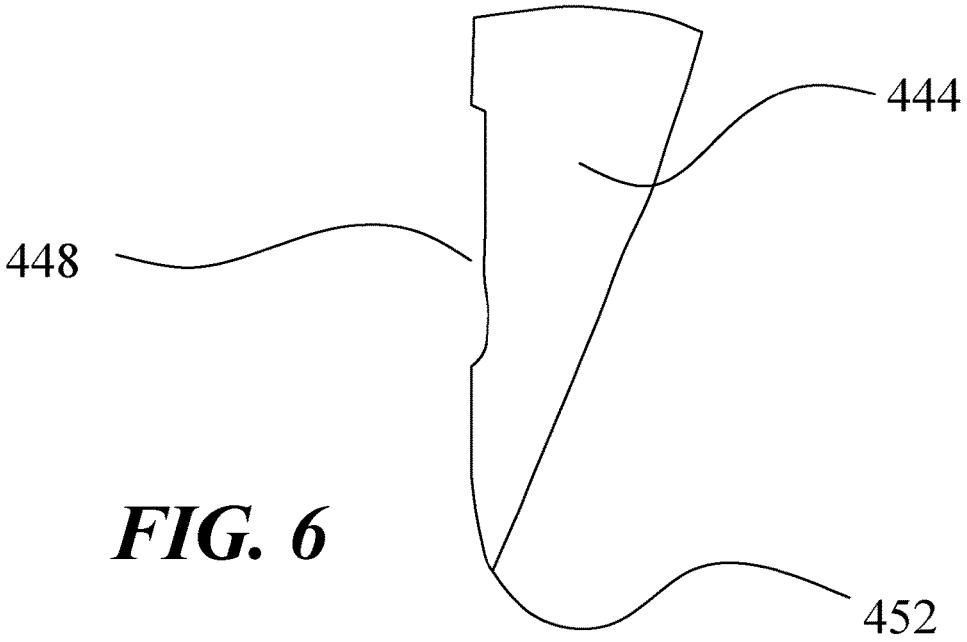
FIG. 6 is a schematic view of a non-limiting example of a tip section in an embodiment.

Referring again to FIGS. 4A-C, needle 108 includes a tip section 444. Tip section 444 is disposed between blade 436 and front end 400; in other words, tip section 444 may be a terminal section of needle 108. Tip section 444 includes a transverse opening 448 through the tip section. Tip section 444 may terminate with a pointed tip 452. Tip section 444 may bevel down to pointed tip 452 with a substantially smooth curvature; this may aid in insertion of tip 452, and subsequently blade 436 into a sheet of flexible material such as textile, as described in further detail below. Referring now to FIG. 6, tip section 444 may have a substantially straight dorsal profile, when seen from the side, which may be a continuation of a substantially straight dorsal profile of at least a portion of blade 436. Tip section 444 may curve slightly as it bevels to tip 452.

Figure 7:
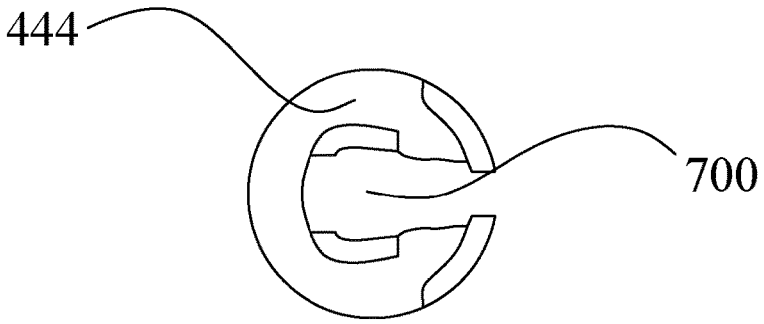
FIG. 7 is a transverse cross-section of a non-limiting example of a tip section in an embodiment.

In an embodiment, tip section 444 may contain a continuation of channel 440; for instance, as illustrated in a non-limiting example in FIG. 7, tip section 444 may include a channel 700; channel 700 may be shallower than channel 440. Channel 700 may be relatively open compared to channel 440 of blade 436; for instance, walls of channel 700 may not overhang channel 700 in the manner in which walls of channel 440 overhang channel 440 as described above.

In an embodiment, tip section 444 and/or blade 436 may have a surface finish. Surface finish may be created by polishing or smoothing tip section 444 and/or blade; as a non-limiting example, surface finish may be achieved by electropolishing. Electropolishing as used herein may be a process whereby an electrolyte solution bathing a surface of tip section 444 and/or blade 436 selectively dissolves portions of the surface having greater electric current density when the solution with immersed surface is subjected to an electric current; greater current density may be found at burrs and other projections of a metallic surface, causing burrs and other projections to be selectively dissolved and making the surface smoother. In an embodiment, a low-friction finish of blade 436 and/or tip section 444 may enable a user to insert needle assembly 100 through textile material with lower effort than on a blade and/or tip section that is not so finished; a low-friction finish of blade 436 may further limit damage to textile material through which blade and/or tip section is inserted. In an embodiment, needle 108 may have different finishes on different sections; for instance, shank 412 may have a first finish, and blade 436 and/or tip section 444 may have a second finish, where the first finish is distinct from the second finish. First finish may be distinct from second finish where first finish has a different coefficient of static friction from second finish. For instance, first finish may be a textured finish as described above, and second finish may be a low-friction finish as described above.

Figure 8:
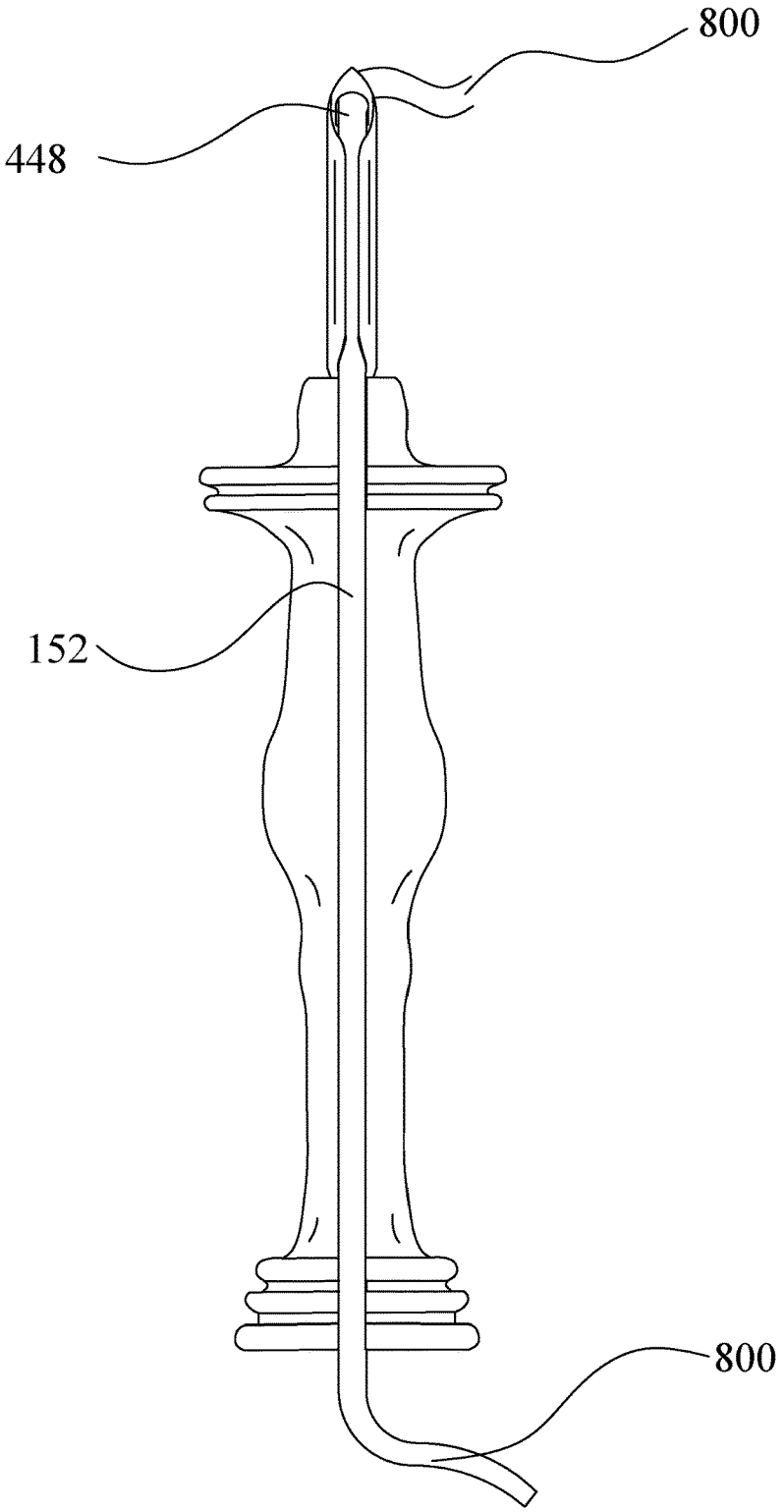
FIG. 8 is a schematic view of a non-limiting example of a needle assembly in operation in an embodiment.

In operation, as shown for example in FIG. 8, a length of elongate flexible material 800 is inserted into the assembled needle assembly 100. Elongate flexible material 800 may include without limitation yarn, which may have single or multiple plies, one or more plies of filament such as nylon filament, cord, cable, wire, or other elongated flexible objects. Material making up elongate flexible material may include any material or combination of materials suitable for creating elongate flexible objects as described above, including without limitation natural fibers such as wools, alpaca or other animal hairs, cotton, linen, or other plant-based fibers, silk, synthetic fibers or filaments such as acrylic, rayon, nylon, or the like, metal wire, or any other elongate material. Elongate material 800 may be inserted through transverse opening 448. Elongate material may be inserted through first slit 152, second slit 432, first bore 200, second bore 428, and/or channel 440, where present. Tip 452 and subsequently blade 436 is then inserted through as sheet of flexible material, which may include without limitation textile material such as "monk's cloth." Needle 100 is subsequently extracted from textile sheet, leaving on the other side a loop of elongate material; this process may be repeated a plurality of times with, for instance, different colors or other variants of elongate material to create desired patterns on the product so formed.

Needle assembly 100 as described above may confer various advantages. Use of adhesive and/or compression fit of shank 412 within first bore 200 may allow rapid and secure insertion of needle 108 into handle 104, resulting in a robust and long-lasting assembly 100; texture surface 424 may aid in securing shank within handle 104, by increasing surface area of adhesive application to the shank 412 and/or by increasing friction between the shank 412 and the first bore 200. Flanges and varied thickness of shaft section 124 may render handle 104 more easily gripped and prevent weariness when assembly 100 is in use. Previous punch needles have been uncomfortable to work with and can cause repetitive motion injuries. The ergonomic design of some embodiments of needle assembly may alleviate this problem using front-end flange 140, rear-end flange 148, or a "bump" formed by a combination of first portion 128, second portion 132, and third portion 136, that gives the user leverage when inserting or pulling out needle assembly 100. These improvements will become apparent to those skilled with the art. A low-friction finish of blade 436 and/or tip section 444 may similarly ease use of needle assembly 100 as compared to other needles because of the lower effort required for insertion and removal of needle 108; the needle 108 may have varied textures, ensuring a strong fit to handle 104 and a simultaneous smooth interface with textile material. The curvature of tip section 444 may permit optimal insertion, minimizing strain at the commencement of the insertion process. Slits 432, 152 may permit easy insertion of elongate material into bores 200, 428, allowing elongate material to thread easily through needle assembly 100 without interfering with a user's grip; as a result, more consistent looping may be achieved.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve methods, systems, and software according to the present disclosure. Accordingly, this description is meant to be taken only by way of example, and not to otherwise limit the scope of this invention.

Furthermore, the foregoing has been a detailed description of illustrative embodiments of the invention. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A needle assembly for use in carpeting, including:

a handle having a forward end and a rear end and a first longitudinal axis running from the forward end to the rear end, the handle including:

a shaft section running along the first longitudinal axis, wherein the shaft section includes:

a first portion, the first portion having a first outer diameter representing a maximal outer diameter of a first portion; and a second portion, wherein the second portion has a second outer diameter representing a maximal outer diameter of the second portion, and the second outer diameter is less than the first outer diameter;

a first bore running along the first longitudinal axis, the first bore having a first maximal diameter, the first bore having a front-end opening in the forward end of the handle; and a first slit running along the longitudinal axis, the first slit connecting the first bore to an exterior surface of the handle; and a needle, having a front end and a back end and a second longitudinal axis running from the front end to the back end, the needle including:

a shank having a terminal end at the back end, the shank having a second maximal diameter permitting insertion in the first bore and a second bore running through the shank in the direction of the longitudinal axis;

a second slit connecting the second bore to an exterior surface of the needle, the second slit aligned with the first slit when the shank is inserted in the first bore to connect the interior of the second bore to the exterior surface of the handle;

a blade, the blade disposed between the shank and the front end; and a tip section, the tip section disposed between the blade and the front end, the tip section having a transverse opening through the tip section, the tip section terminating at the front end with a pointed tip.

2. The needle assembly of claim 1, wherein second portion of the shaft section is disposed between the first portion of the shaft section and the rearward end of the handle.

3. The needle assembly of claim 2, wherein the shaft section further comprises a third portion, wherein:

the third portion has a third outer diameter representing a maximal outer diameter of the third portion;

the third outer diameter is less than the first outer diameter; and the third portion is disposed between the first portion and the forward end of the handle.

4. The needle assembly of claim 1, wherein the handle further comprises a front-end flange separating the shaft section from the front end, the front-end flange having a fourth outer diameter representing a maximal outer diameter of the front-end flange, wherein the fourth outer diameter is greater than the first outer diameter.

5. The needle assembly of claim 4, wherein the handle further comprises a collar located at the front end, the collar having a fifth outer diameter representing a maximal outer diameter of the collar, the collar surrounding the front-end opening of the first bore, wherein the fifth outer diameter is less than the fourth outer diameter.

6. The needle assembly of claim 1, wherein the handle further comprises a rear-end flange located at the rear end and separating the shaft section from the rear end, wherein the rear-end flange has a sixth outer diameter representing a maximal outer diameter of the rear-end flange, wherein the sixth outer diameter is greater than the first outer diameter.

7. The needle assembly of claim 1, wherein the first bore further comprises a rear-end opening at the rear end of the handle.

8. The needle assembly of claim 1, wherein the shank further comprises a second bore running through the shank in the direction of the second longitudinal axis.

9. The needle assembly of claim 8, wherein the shank further comprises a second slit connecting the second bore of the shank to an exterior surface of the shank.

10. The needle assembly of claim 1, wherein the shank further comprises a textured outer surface.

11. The needle assembly of claim 1, wherein the blade further comprises a transverse curvature forming a channel running parallel to the second longitudinal axis.

12. The needle assembly of claim 11, wherein the channel connects to the second bore.

13. The needle assembly of claim 12, wherein the channel connects to the second slit.

14. The needle assembly of claim 1, wherein the blade has a low-friction finish.

15. The needle assembly of claim 1, wherein the tip section has a low-friction finish.

16. The needle assembly of claim 1, wherein the shank is secured in the first bore using an adhesive.

* * * * *